US007540651B2

(12) United States Patent
Matsumoto et al.

(10) Patent No.: US 7,540,651 B2
(45) Date of Patent: Jun. 2, 2009

(54) AGITATOR, A CIRCULATORY CLEANING DEVICE ATTACHED TO THE AGITATOR, AND A CIRCULATORY LINE SYSTEM COMPRISING THE CIRCULATORY CLEANING DEVICE

(75) Inventors: Hiroyuki Matsumoto, Hiratsuka (JP); Mutsuo Kuramoto, Hiratsuka (JP); Masahiko Hiraki, Hiratsuka (JP)

(73) Assignee: Kansai Paint Co., Ltd., Hogyo-ken (JP)

( * ) Notice: Subject to any disclaimer, the term of this patent is extended or adjusted under 35 U.S.C. 154(b) by 392 days.

(21) Appl. No.: 11/092,294

(22) Filed: Mar. 28, 2005

(65) Prior Publication Data

US 2005/0232071 A1 Oct. 20, 2005

(30) Foreign Application Priority Data

Mar. 29, 2004 (JP) ..... 2004-093985
Mar. 29, 2004 (JP) ..... 2004-093992
Mar. 29, 2004 (JP) ..... 2004-094136

(51) Int. Cl.
*B01F 7/20* (2006.01)

(52) U.S. Cl. ..... 366/147; 366/149; 366/325.92; 165/92

(58) Field of Classification Search ..... 165/92, 165/DIG. 152–DIG. 155; 366/325.92, 147, 366/149
See application file for complete search history.

(56) References Cited

U.S. PATENT DOCUMENTS 15,432 A * 7/1856 Morfit ..... 165/92
217,701 A * 7/1879 McLaren ..... 165/92
634,999 A * 10/1899 Schaaf ..... 510/481

(Continued)

FOREIGN PATENT DOCUMENTS

DE 19742684 4/1999

(Continued)

OTHER PUBLICATIONS

Machine generated translation of JP 2000-300978, generated Sep. 12, 2007.*

*Primary Examiner*—David L Sorkin
(74) *Attorney, Agent, or Firm*—Knobbe, Martens, Olson & Bear LLP

(57) ABSTRACT

An agitator able to mix and disperse a variety of fluids of various fluid volumes with different viscosities ranging from low to high, and having excellent, cleanability and improved cooling efficiency is provided. The agitator comprises a rotating shaft 3 extending vertically inside an agitating vessel 2, and a flat paddle blade 4 mounted on the rotating shaft 3. The flat paddle blade has a bottom flat paddle blade portion 4*a* extending outwards from the bottom of the rotating shaft 3 and a rectangular upper flat paddle blade portion 4*b* extending upward from an upper part of each side end of the bottom flat paddle blade portion 4*a*. The dimensional ratio (b/a) of the blade diameter (b) of the bottom flat paddle blade portion 4*a* to the inner diameter (a) of the agitating vessel 2 is from 0.6 to 0.9, and the dimensional ratio (d/c) of the height (d) of an upper flat paddle blade portion 4*b* to the height (c) of the bottom flat paddle blade portion 4*a* is from 1 to 4. A passage 12 is formed inside the rotating shaft 3 and flat paddle blade 4 for passing a coolant medium therethrough.

9 Claims, 7 Drawing Sheets

U.S. PATENT DOCUMENTS

| | | | | | |
|---|---|---|---|---|---|
| 781,529 | A | * | 1/1905 | Jensen | 165/74 |
| 1,587,840 | A | * | 6/1926 | Kilmer | 366/147 |
| 1,599,730 | A | * | 9/1926 | Telles | 165/92 |
| 1,667,944 | A | * | 5/1928 | Nichols | 165/92 |
| 3,168,431 | A | * | 2/1965 | Spielvogel | 159/37 |
| 3,820,597 | A | * | 6/1974 | Bittner et al. | 165/109.1 |
| 3,951,682 | A | | 4/1976 | Schevey et al. | |
| 4,395,133 | A | | 7/1983 | Clevenholm et al. | |
| 4,754,437 | A | | 6/1988 | Doom et al. | |
| 5,062,577 | A | | 11/1991 | Schmitt et al. | |
| 5,106,199 | A | | 4/1992 | Eckel et al. | |
| 5,232,299 | A | | 8/1993 | Hiss et al. | |
| 5,534,078 | A | | 7/1996 | Breunsbach et al. | |
| 5,634,715 | A | | 6/1997 | Stehr et al. | |
| 6,244,741 | B1 | * | 6/2001 | Akamine et al. | 366/325.92 |
| 6,296,384 | B1 | * | 10/2001 | Yatomi et al. | 366/147 |
| 6,364,520 | B1 | * | 4/2002 | Steele | 366/147 |

FOREIGN PATENT DOCUMENTS

| | | |
|---|---|---|
| FR | 1502467 | 11/1967 |
| GB | 2097819 | 11/1982 |
| GB | 2183496 | 6/1987 |
| JP | 1-37173 | 9/1986 |
| JP | 1218625 | 8/1989 |
| JP | 6-28745 | 4/1994 |
| JP | 8-266880 | 10/1996 |
| JP | 08 252445 | 2/1997 |
| JP | 3224498 | 3/1997 |
| JP | 2000 300978 | 10/2000 |
| JP | 2002-306940 | 10/2000 |
| JP | 3189047 | 5/2001 |
| JP | 2002-204969 | 7/2002 |
| JP | 2002 095946 | 8/2002 |
| JP | 2002 301350 | 10/2002 |

* cited by examiner

AGITATOR, A CIRCULATORY CLEANING DEVICE ATTACHED TO THE AGITATOR, AND A CIRCULATORY LINE SYSTEM COMPRISING THE CIRCULATORY CLEANING DEVICE

TECHNICAL FIELD

The present invention relates to an agitator, a circulatory cleaning device attached to the agitator, and a circulatory line system comprising the circulatory cleaning device.

BACKGROUND ART

Conventionally, coating compositions, inks and like coloring liquids are clear varnishes containing pigment pastes. Pigment pastes are generally prepared by the steps of mixing pigments, resins, organic solvents, and like raw materials in an agitator to prepare a mill base, and then passing this mill base a few times through a bead mill dispersion apparatus or like continuous dispersion apparatus to disperse the pigment.

Specifically, the commonly employed pigment dispersion method comprises the steps of feeding an unprocessed pigment paste stored in a feeding vessel to a dispersion apparatus, temporarily storing the pigment paste obtained by dispersing it in the dispersion apparatus in a receiving vessel, returning the pigment paste stored in the receiving vessel to the dispersion apparatus to redisperse it after the completion of the first pigment dispersion process, and returning the pigment paste which has been subjected to the second pigment dispersion process to the feeding vessel to store it, and then repeating these processes a few times. The above-mentioned manufacturing process, however, disadvantageously requires two vessels, i.e., feeding vessel and receiving vessel, and operations to switch between these vessels.

To overcome these disadvantages, a known technique connects an agitator and a dispersion apparatus via a circulation line to circulate pigment paste between the apparatuses, unifying the feeding vessel and receiving vessel (for example, refer to Japanese Unexamined Patent Publication Nos. 1996-266880 and 2002-306940).

A known bead mill apparatus (cf. Japanese Unexamined Patent Publication No. 1996-266880, Japanese Examined Patent Publication No. 1994-28745 and Japanese Unexamined Patent Publication No. 2002-204969) having a mechanism which separates pigment paste from a grinding medium by the action of centrifugal force caused by the rotation of a rotor has such advantages that it has a large throughput (flow rate); it requires only one vessel because it allows circulation dispersion; and it does not require a switching operation between a feeding vessel and a receiving vessel because it has only one vessel.

However, even if a pigment is dispersed and mixed by using the above-mentioned bead mill apparatus, there is the disadvantage that insufficient agitating and mixing in an agitator may cause mill base to short-path when the pigment flows in and out around the agitator (for example, anchor type, propeller type), and that the efficiency of the pigment dispersion is lowered if there is any pooling in the vessel. Here, "short-path" means that fluid supplied in an agitator is discharged from the agitator without fully being agitated.

Accordingly, to efficiently perform agitating and mixing in the agitator, a double-shafted mixer having a high-speed agitator and a low-speed anchor type agitating blade which removes the pooled mill base off the vessel wall was developed.

However, said double-shaft mixer has the problem of high installation cost. In addition, since a small interval between the vessel wall and anchor type agitating blade makes cleaning the mill base by injecting a cleaning solvent difficult, the mixer still has a problem in its ability to be cleaned when the mixer is applied to the production of coating compositions, which requires the frequent replacement of materials.

There are other known mixers, for example, single shaft mixers, than the above-mentioned agitators (for example, refer to Japanese Patent No. 3224498 and Japanese Examined Patent Publication No. 1989-37173). Although these agitators are suitable for simply mixing a fluid in a vessel homogenously, when they are used for circulation dispersion systems which drive fluid drawn from a lower part of the vessel from a return pipe provided in an upper part of the vessel into the vessel, and return the drawn fluid to the return pipe through a dispersion apparatus, they have the following disadvantage: as the circulating flow of the fluid in the vessel becomes faster, the fluid provided by the return pipe fails to be mixed and short-paths in the vessel because it is instantaneously drawn from the lower part of the vessel. Furthermore, it is less effective than an anchor type agitating blade in drawing fluid off the inner wall portion of the vessel in the agitator, mixing it, and circulating it. Therefore, pigment paste with high structural viscosity is likely to pool on the wall of the vessel and thus is disadvantageously difficult to mix and agitate.

To overcome the aforementioned problems, the inventors of the present invention have previously improved the constitution of paddle blades and proposed an agitator which can be applied to a circulatory system with a large flow rate, can deal with a variety of fluids, changes in fluid volume, and has an excellent ability to mix and disperse fluids with different viscosities ranging from low to high and cleanability (refer to Japanese Patent No. 3189047).

Moreover, the production of coating compositions and like coloring liquids is often in small batches of a wide variety of products. Therefore, every time the color is changed, the agitating vessel and other portions which come in contact with the pigment paste need to be cleaned. In a known cleaning step, for example, a cleaning device ejects a cleaning liquid from a cleaning nozzle connected to a cleaning liquid tank into the agitating vessel (for example, refer to Japanese Patent No. 3189047). This cleaning device showers the inner wall of the agitating vessel and the surface of the agitating blade with the cleaning liquid from the cleaning liquid tank via the cleaning nozzle to wash away pigment paste deposited therein. The cleaning liquid ejected from the cleaning liquid nozzle into the agitating vessel is immediately drawn out from the bottom of the agitating vessel, collected and recycled.

SUMMARY OF CERTAIN ASPECTS

However, the heating generated by the friction between the grinding medium and the rotor or vessel inside a bead mill and the friction within the grinding medium is greater than the cooling provided by the vessel of the bead mill. Consequently, the temperature of the pigment paste increases. The pigment paste is sometimes deteriorated by elevated temperatures, and therefore the heat generated by the pigment paste becomes greater as its viscosity increases.

One embodiment provides an agitator with further improvements in its flat paddle blade, and an agitating vessel with the improved agitator previously suggested by the inventors of the present invention to mainly increase the cooling efficiency of the agitator.

Moreover, although the aforementioned known improved agitator previously proposed by the inventors of the present invention is capable of cleaning the flat paddle blade and the inner wall of an agitating vessel by circulating a cleaning liquid and has a much higher cleanability than the aforementioned known double-shaft mixer because it employs a flat paddle blade, pigment paste deposited on the outermost peripheral surface (flat surface) of the flat paddle blade and the pigment paste deposited on the bottom of the agitating vessel are sometimes a little difficult to scrape off.

In cleaning the aforementioned known improved agitator, for example, a cleaning liquid is collected in the agitating vessel, and then the flat paddle blade and the inner wall of the agitating vessel is cleaned by rotating the flat paddle blade backwards and forwards. At this time, the cleaning liquid simultaneously cleans the inside of the bead mill apparatus by circulating through the circulatory channel connecting the bead mill apparatus and the agitator.

The inventors of the present invention have conducted extensive research, and consequently found the previously proposed improved agitator, pigment paste deposited on the flat surface around the agitating blade tends to pool during circulation dispersion since the peripheral edge of the agitating blade is a flat surface as shown in the cross section of FIG. 8, which results in lowered dispersibility. They also found that pigment paste readily adheres and deposits on the flat surface of the agitating blade and cannot be sufficiently cleaned by the cleaning liquid ejected from the cleaning nozzle.

Moreover, the inventors of the present invention have found that the flow of cleaning liquid fed through a fluid inlet provided in an upper part of the agitating vessel, discharged through a fluid outlet provided in the bottom, and circulated inside the agitator and bead mill apparatus through the circulatory channel of the bead mill apparatus sometimes pools at the bottom of the agitating vessel.

At least one embodiment described herein provides an agitator with increased cleanability of a paddle blade and an agitating vessel of the agitator.

Moreover, known cleaning devices which clean agitating vessels and the like require a large amount of a cleaning liquid for a sufficient level of cleaning to be achieved.

Furthermore, if the agitator and dispersion apparatus is connected with a pipe, to make sure that no cleaning liquid or the like is left when changing colors, the pipe needs to be disassembled and its inside cleaned. This requires a great deal of work and significantly increases production costs.

At least one embodiment described herein provides a circulatory cleaning device which can reduce the amount of a cleaning liquid used.

At least one embodiment described herein provides a circulatory line system which can reduce the amount of cleaning liquid used and the labor required for cleaning in a system in which an agitator and a dispersion apparatus are connected via a pipe.

In one embodiment, the agitator comprises an agitating vessel which has a fluid inlet in an upper part thereof, a fluid outlet at the bottom, and a cylindrical circumferential configuration; a rotating shaft extending vertically inside the agitating vessel; and a flat paddle blade mounted on said rotating shaft, the flat paddle blade having a bottom flat paddle blade portion which extends outwards from the bottom of the rotating shaft, and oblong upper flat paddle blade portions extending upward from an upper part of each side end of the bottom flat paddle blade portion, the dimensional ratio (b/a) of the blade diameter (b) of the bottom flat paddle blade portion to the inner diameter (a) of the agitating vessel being in the range of from 0.6 to 0.9, the dimensional ratio (d/c) of the height (d) of the upper flat paddle blade portion to the height (c) of the bottom flat paddle blade portion being in the range of from 1 to 4, and a passage to pass a coolant medium through the rotating shaft and the flat paddle blade.

In one embodiment, the agitator further comprises a coolant jacket around the agitating vessel.

The agitator may include an agitating vessel comprising a fluid inlet in an upper part thereof, a fluid outlet at the bottom, and having a cylindrical peripheral configuration; a rotating shaft extending vertically inside the agitating vessel; and a flat paddle blade mounted on said rotating shaft, the flat paddle blade having a bottom flat paddle blade portion which extends outwards from the bottom of the rotating shaft and a oblong upper flat paddle blade portion extending upward from an upper part of each side end of the bottom flat paddle blade portion, the outermost periphery of the flat paddle blade being tapered by two inclined surfaces.

The outermost periphery of the flat paddle blade may have a V-shaped peripheral configuration formed by the two inclined surfaces and each of said inclined surfaces is formed so that the internal angle ($\theta_1$) between a flat surface of the flat paddle blade and the inclined surface is in the range of from 100° to 140°.

In one embodiment, the bottom configuration of the agitating vessel is in the shape of a cone or a truncated cone tapering downwards, and the bottom configuration of the bottom flat paddle blade portion is formed parallel with the bottom of the agitating vessel.

The bottom conical surface of the agitating vessel may have an inclination so that the angle ($\theta_2$) of the surface is 5°-30° from horizontal.

In one embodiment, the dimensional ratio (e/b) of the width (e) of each upper flat paddle blade portion to the blade diameter (b) of the bottom flat paddle blade portion is in the range of from 0.05 to 0.2.

The circulatory cleaning device may be a circulatory cleaning device attached to an agitator for agitating pigment paste, the device comprising a cleaning liquid tank storing a cleaning liquid; a first pump which suctions a liquid in said cleaning liquid tank and feeds the liquid into the agitating vessel; and a second pump having a suction opening connected to an outlet provided at the bottom of the agitating vessel, and a discharge opening connected to an inlet of the cleaning liquid tank by a circulatory cleaning pipeline.

In one embodiment, in the circulatory cleaning device, a first directional control valve, which further comprises a waste fluid tank which receives cleaning waste fluid and switches so that a liquid discharged from the second pump is discharged into the waste fluid tank, is provided in the circulatory cleaning pipeline.

The circulation dispersion system may comprise the above circulatory cleaning device; the above agitator having an agitating blade and agitating vessel; and a dispersion apparatus provided in the circulatory cleaning pipeline for disaggregating pigment aggregates comprising secondary particles into primary particles and dispersing these primary particles in pigment paste, a second directional control valve which switches so that liquid discharged from the second pump is fed to the dispersion apparatus, wherein an outlet of the dispersion apparatus and a inlet of the agitating vessel are connected by a pipeline for circulation dispersion.

In one embodiment, the circulation dispersion system comprises a product tank in the pipeline for circulation dispersion for receiving pigment paste which has been subjected to the above dispersion process, and a third directional control valve which switches to discharge liquid discharged from the second pump into the product tank.

In one embodiment, the dispersion apparatus of the circulation dispersion system is an annular bead mill which has a vessel having an inlet which supplies pigment paste for dispersing and an outlet which discharges the dispersed pigment paste; and a rotor having a cylindrical outer peripheral surface and disposed inside the vessel to form an annular gap for performing dispersion between itself and the inner wall of the vessel. In one embodiment, the annular gap comprises a passage through the inside of the rotor to the outlet; that a centrifuge for centrifuging a grinding medium from grinding medium/pigment paste mixture in the passage inside the rotor is provided; and that an opening for circulation for discharging the centrifuged grinding medium into the annular gap is provided in the rotor.

In one embodiment, the centrifuge comprises a rotary member which centrifuges the grinding medium and said rotary member is an impeller or a rotational disk.

In one embodiment, the rotational drive shaft of the rotor is a hollow shaft and that an outlet communicating with the outlet of the vessel is formed in said hollow shaft. In one embodiment, the inlet of the vessel is disposed on one end of the vessel; an approximately cylindrical stator is further disposed approximately on the other end of the vessel inside the rotor; and that a gap constituting a part of the passage is formed between said stator and the rotor.

In one embodiment, a rotational drive shaft of the rotary member is inserted into the hollow shaft of the rotor and a gap constituting a passage leading to the outlet opening is formed between inner circumferential wall of the hollow shaft of the rotor and the rotational drive shaft of the rotary member. In one embodiment, the rotational drive shaft of the rotor and the rotational drive shaft of the rotary member are disposed concentrically.

DETAILED DESCRIPTION OF CERTAIN INVENTIVE EMBODIMENTS

Figure 1:
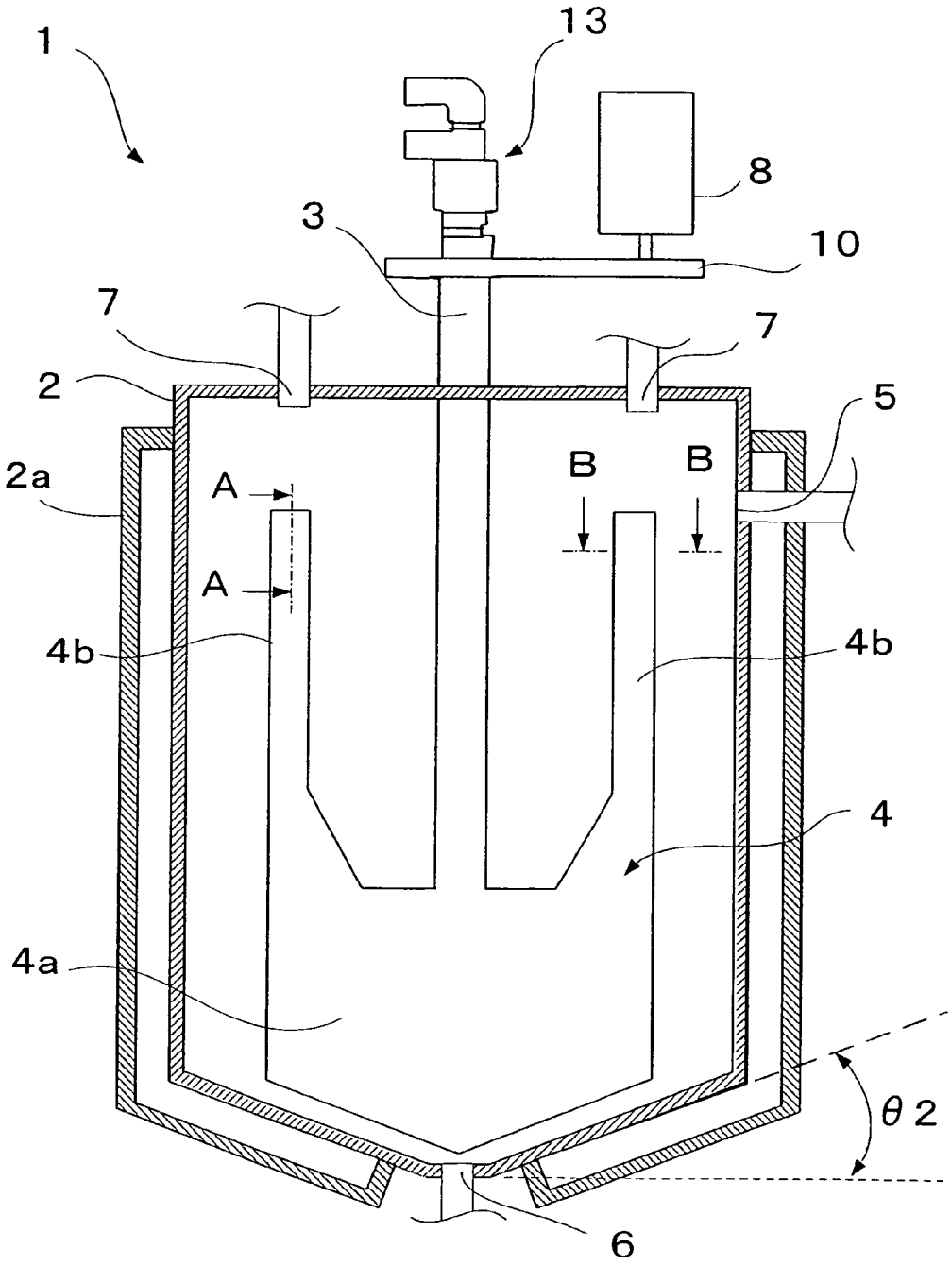
FIG. 1 is a longitudinal sectional view showing one embodiment of an agitator.
Figure 2:
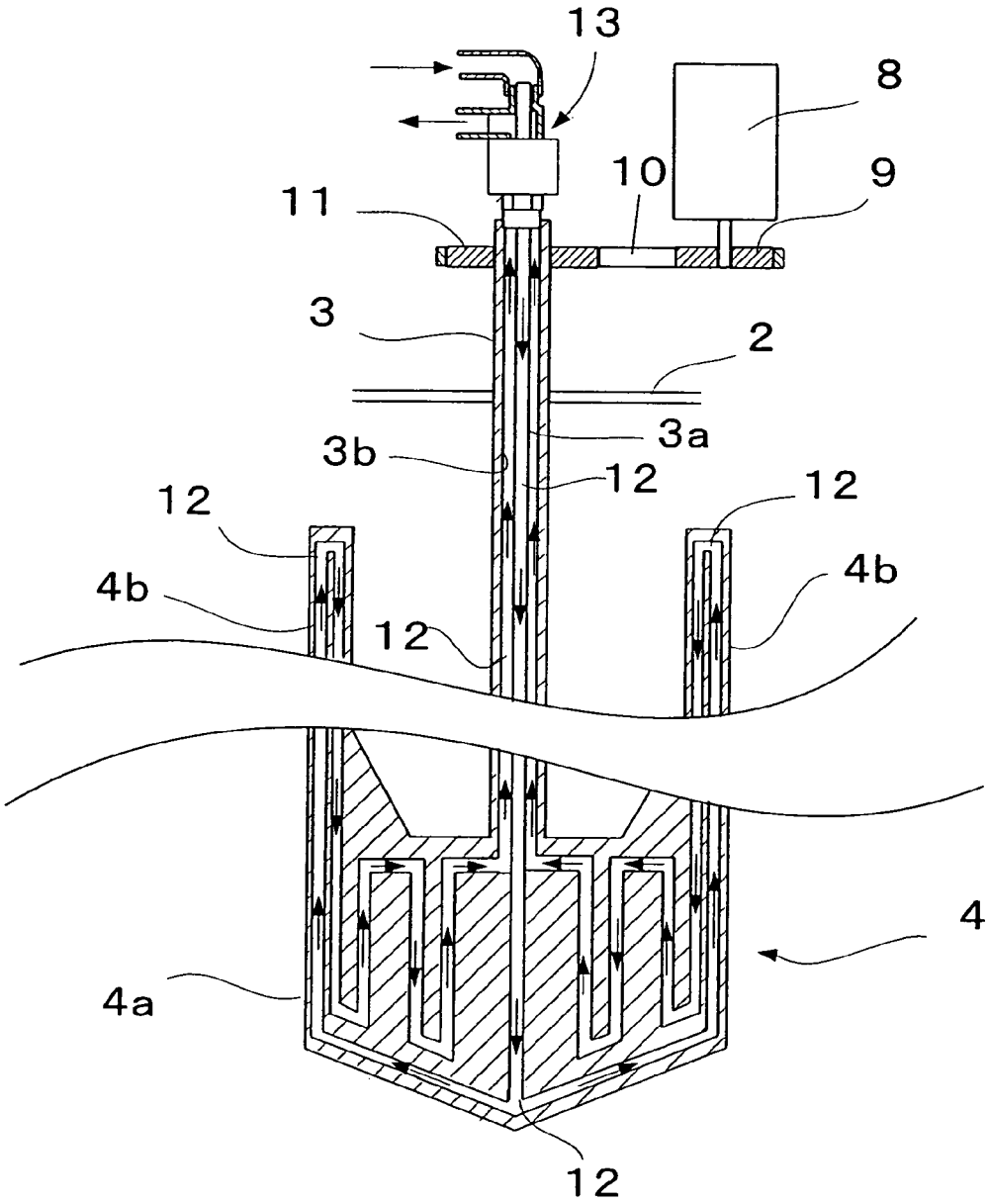
FIG. 2 is a longitudinal sectional view showing the inner structure of a component of the agitator of FIG. 1, a flat paddle blade, with partial omission.

A first embodiment of an agitator will be described with reference to FIGS. 1-3 below. FIG. 1 is a longitudinal sectional view showing the inner structure of the agitator, and FIG. 2 is a partial longitudinal sectional view showing the inner structure of the flat paddle blade part of FIG. 1.

The agitator 1 comprises an agitating vessel 2; a rotating shaft 3 extending vertically in the inner center of the agitating vessel 2; and a flat paddle blade 4 as an agitating blade mounted on the rotating shaft 3.

The agitating vessel 2 comprises a fluid inlet 5 in an upper part thereof and a fluid outlet 6 at the bottom. It has a cylindrical circumferential side face and a coolant jacket 2*a* therearound.

The coolant jacket can be of a known constitution, and allows a coolant medium such as a coolant water to circulate inside. In one embodiment, the configuration of the bottom of the agitating vessel 2 is a truncated cone with the narrow portion downwards. Moreover, the agitating vessel 2 comprises cleaning liquid inlets 7, 7 in an upper part thereof.

The flat paddle blade 4 comprises a bottom flat paddle blade portion 4*a* which extends outwards from the bottom of the rotating shaft 3, and oblong upper flat paddle blade portions 4*b* which extend upward from an upper part of each side end of the bottom flat paddle blade portion 4*a*.

In one embodiment, the bottom configuration of the bottom flat paddle blade portion 4*a* is formed by inclined sides parallel to the bottom conical surface of the agitating vessel 2, and has a predetermined clearance between itself and the bottom face of the agitating vessel 2.

In one embodiment, each upper flat paddle blade portion 4*b* is set up symmetrically with respect to the rotating shaft 3. The rotating shaft 3 is rotationally driven by a drive 8 disposed external to the vessel via a pulley 9, pulley belt 10 and pulley 11, and the rotational drive of the rotation shaft 3 causes the flat paddle blade 4 to pass near the cylindrical inner wall face of the agitating vessel 2 as it rotates.

In the rotating shaft 3 and flat paddle blade 4, a passage 12 is formed to pass a coolant medium through the flat paddle blade 4 via the rotating shaft 3. In one embodiment, the passage 12 formed in the flat paddle blade 4 is formed in both the bottom flat paddle blade portion 4*a* and upper flat paddle blade portion 4*b*. In one embodiment, a coolant medium which is cooled by a cooler (not shown) to −10° C. to 10° C. can be used.

In the embodiment illustrated, the inner portion of the rotating shaft 3 has a double pipe structure. The coolant medium flows, as shown by the arrows in FIG. 2, through the passage 12 formed inside the flat paddle blade 4, through the passage 12 formed by an inner pipe 3*a*, and is then discharged via the passage 12 formed by an outer pipe 3*b* of the double pipe. At the upper end of the rotating shaft 3, a duplex rotary joint 13 corresponding to the double pipe is mounted so that coolant medium can be supplied and discharged from the upper end of the rotating shaft even during rotation of the rotating shaft 3.

Figure 3:
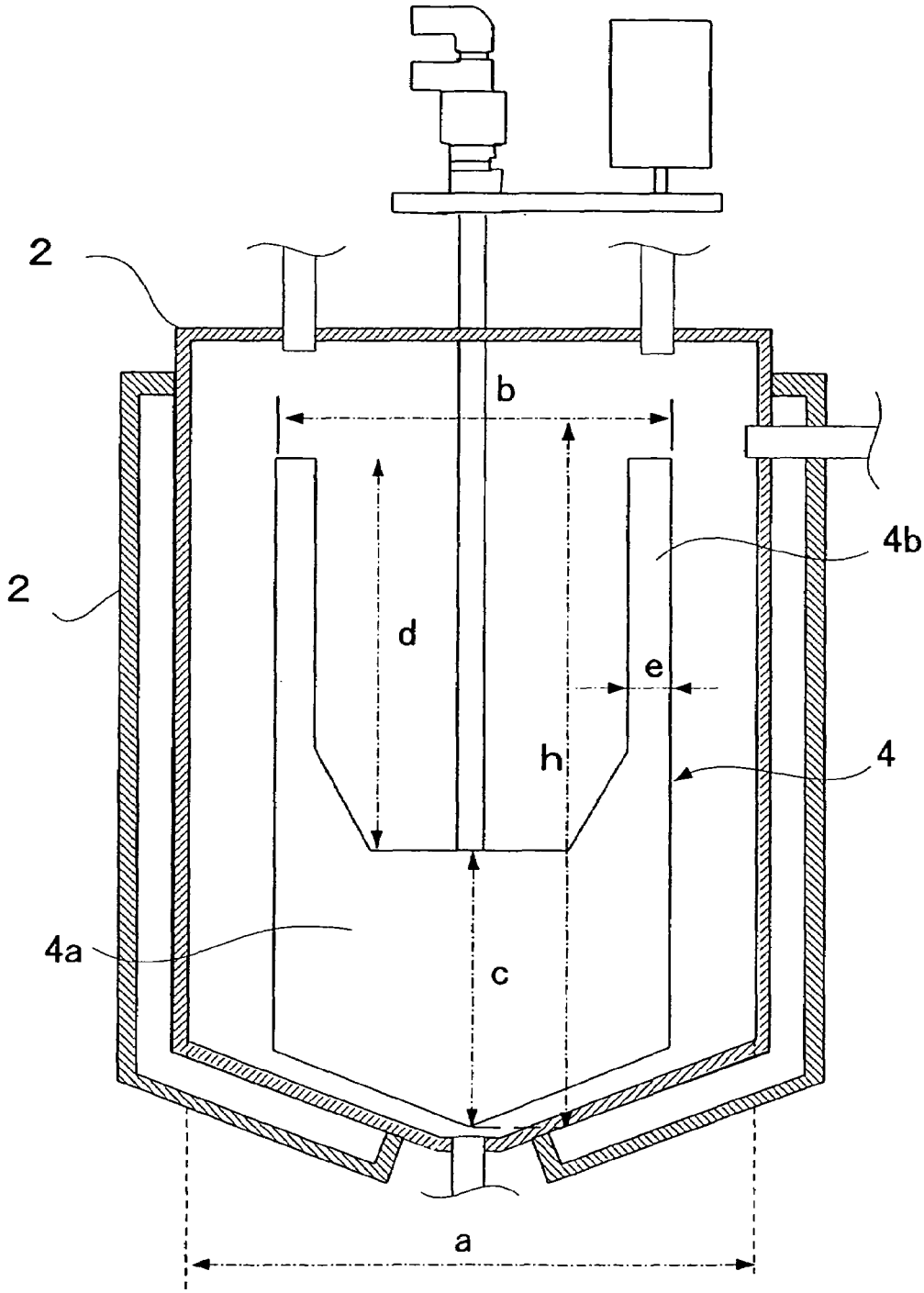
FIG. 3 is a longitudinal sectional view showing the agitator of FIG. 1.

In one embodiment, as shown in FIG. 3, the bottom flat paddle blade portion 4*a* is configured so that the dimensional ratio (b/a) of the blade diameter b to the inner diameter a of the agitating vessel 2 may fall within the range of from 0.6 to 0.9, or from 0.6 to 0.8. If the dimensional ratio (b/a) is lower than 0.6, the blade diameter is too small compared to the inner diameter of the agitating vessel 2 and therefore too much pigment paste pools at the vessel wall surface. On the other hand, if the dimensional ratio (b/a) is higher than 0.9, the blade diameter becomes too large compared to the inner diameter of the agitating vessel 2, causing pigment paste to easily short-path.

In one embodiment, the flat paddle blade 4 is designed so that the dimensional ratio (d/c) of the height d of the upper flat paddle blade portion 4*b* to the height c of the bottom flat paddle blade portion 4*a* may fall within the range of from 1 to 4, or from 1 to 3. If this height dimensional ratio (d/c) is lower than 1, that is, the height d of the upper flat paddle blade portion 4*b* is too low relative to the height c of the bottom flat paddle blade portion 4*a*, the driving force for agitation may be too large. This may disadvantageously result in high production costs, accelerated deterioration of machinery due to heavy loads, and increased chances of pigment paste short-pathing. On the other hand, if the dimensional ratio (d/c) is higher than 4, in other words, if the height d of the upper flat paddle blade portion 4*b* becomes too high relative to the height c of the bottom flat paddle blade portion 4*a*, pigment paste disadvantageously fails to be mixed homogenously in the vessel.

In one embodiment, the flat paddle blade 4 is designed so that the dimensional ratio (h/a) of overall height, i.e., (d+c), of the flat paddle blade 4 to the inner diameter a of the agitating vessel 2 may fall within the range of from 0.8 to 1.5, or from 1.0 to 1.3. If this dimensional ratio (h/a) of height is lower than 0.8, that is, if the overall height h of the flat paddle blade 4 becomes too short relative to the inner diameter a of the agitating vessel 2, pigment paste disadvantageously tends to short-path. On the other hand, if the dimensional ratio (h/a) is higher than 1.5, that is, if the overall height h of the flat paddle blade 4 becomes too long relative to the inner diameter a of the agitating vessel 2, pigment paste disadvantageously fails to be mixed homogenously in the vessel.

In one embodiment, the oblong upper flat paddle blade portion 4*b* is a blade whose longest dimension is in the direction of height, and its width e is such that the dimensional ratio (e/b) of the blade width of the upper flat paddle blade portion 4*b* to the diameter b of the bottom flat paddle blade portion 4*a* may fall within the range of from 0.05 to 0.2, or from 0.06 to 0.15. If the dimensional ratio (e/b) is lower than 0.05, the effect in removing pigment paste in the vicinity of the inner vessel surface is reduced. On the other hand, if it is higher than 0.2, pigment paste tends to short-path.

In another embodiment, the dimensional ratio (c/b) of the height c of the bottom flat paddle blade portion 4*a* to the blade diameter b of the same may be from 0.4 to 1.0, or from 0.5 to 0.7. If the dimensional ratio (c/b) is lower than 0.4, the agitating effect is lowered. On the other hand, if the dimensional ratio (c/b) is higher than 1.0, the load applied to the apparatus is too large, which accelerates deterioration.

In one embodiment, the flat paddle blade 4 is constituted by a single piece. Moreover, the material(s) constituting the flat paddle blade 4 are not limited and materials which have been used for prior art agitating blades may be used. In one embodiment, stainless steel is advantageous from the aspect of durability and strength. In one embodiment, from the aspect of cleanability, the surface is mirror finished or a Teflon® coating or glass lining is applied to the surface. In one embodiment, when the capacity of the agitating vessel 2 is 500 liters, the thickness of the flat paddle blade 4 is 10-30 mm.

In one embodiment, the capacity of the agitating vessel 2 is not particularly limited, but in general ranges from about 2 liters to about 10000 liters.

Figure 4:
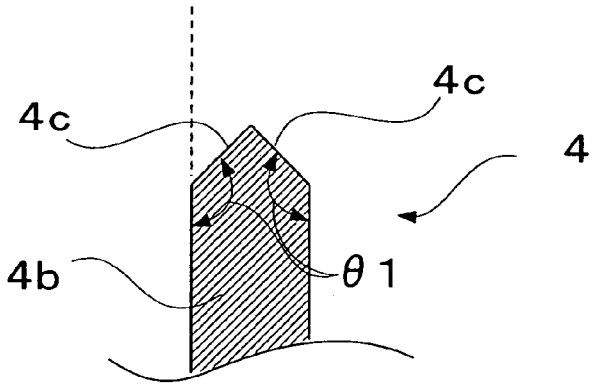
FIG. 4 is a cross-sectional view taken along the line A-A of FIG. 1.
Figure 5:
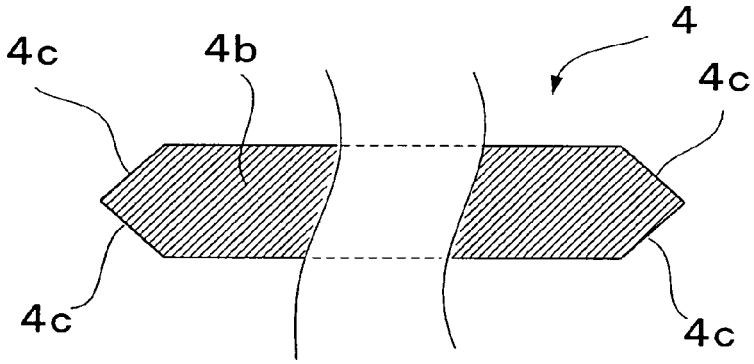
FIG. 5 is a cross-sectional view taken along the line B-B of FIG. 1.
Figure 6:
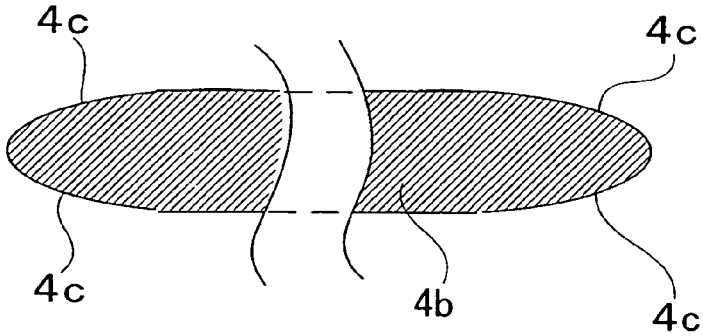
FIG. 6 shows another form of a component of an agitator according to one embodiment of the present invention, a flat paddle blade, and is a cross-sectional view corresponding to the cross section taken along the line B-B of FIG. 1.

In a second embodiment, the flat paddle blade 4 has, as shown in the cross sectional configurations of FIGS. 4 and 5, a peripheral portion which is entirely tapered by inclined surfaces 4*c*, 4*c* formed two sides and has a V-shaped cross sectional configuration. In the examples shown in FIGS. 4 and 5, the inclined surfaces 4*c*, 4*c* are flat surfaces, but they can also be formed by curving faces as shown in the cross-sectional view of FIG. 6. Moreover, the tip tapered by the inclined surfaces 4*c*, 4*c*, is illustrated as a sharp point in the examples shown in FIGS. 4 and 5, but can be, for example, of rounded U-shaped cross sectional configuration shown in FIG. 6. It should be noted that the cross sectional configuration of only the upper flat paddle blade portion 4*b* is shown in FIGS. 4-6, but the case for the bottom flat paddle blade portion 4*a* is also the same.

In one embodiment, the agitators of the aforementioned first and second embodiments are mainly used to be incorporated into a circulation dispersion system connected to a dispersion apparatus.

Figure 9:
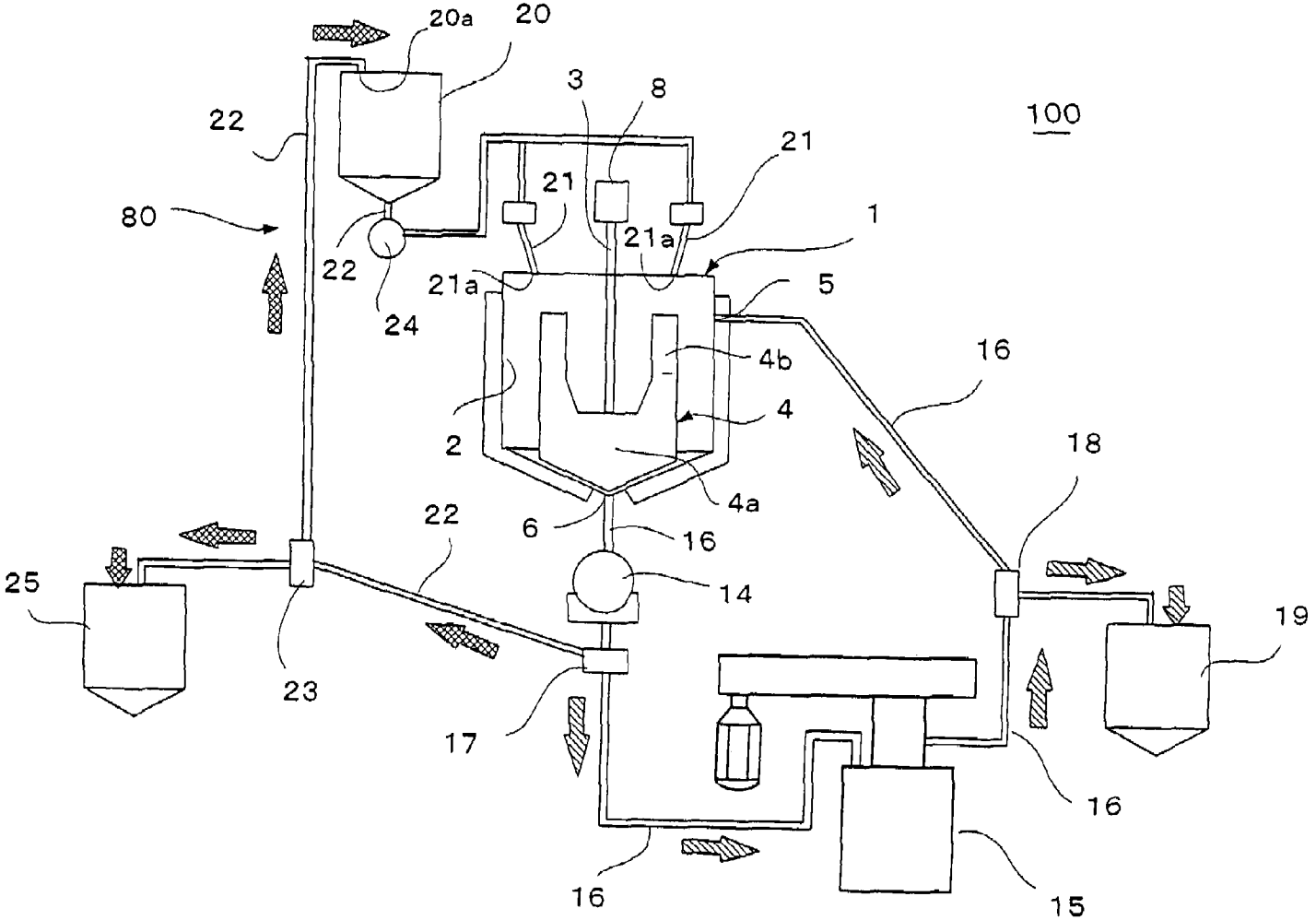
FIG. 9 is a system drawing showing one embodiment of the circulatory cleaning device and a circulation dispersion system comprising said circulatory cleaning device.

A suitable embodiment of such a circulation dispersion system will be described with reference to FIGS. 9-11 below. It should be noted that in FIG. 9, the circulation dispersion system 100 comprising the agitator 1, a circulatory cleaning device 80 connected to the agitator 1 by a circulatory cleaning pipeline, and a dispersion apparatus 15 connected to the agitator 1 by a circulation dispersion pipeline 16, and will be described as an example of this embodiment.

The circulatory cleaning device 80 comprises a cleaning liquid tank 20 for storing a cleaning liquid such as water and solvent; a first pump 24 which suctions the cleaning liquid from the cleaning liquid tank 20 and provides cleaning liquid inlets 21*a*, 21*a* of the agitating vessel 2 with the liquid therein; and a second pump 14 whose suction opening is connected to a fluid outlet 6 provided at the bottom of the agitating vessel 2 and whose discharge opening is connected to a cleaning liquid inlet 20*a* of the cleaning liquid tank 20 by a circulatory cleaning pipeline 22.

In one embodiment, the cleaning nozzle 21 of the agitating vessel 2 comprises cleaning liquid inlets 21*a*, 21*a*, and a cleaning liquid pumped out from the first pump 24 is ejected via the cleaning nozzle 21 at high pressure like a shower at the agitating vessel 2 and the flat paddle blade 4 as an agitating blade.

In one embodiment, the cleaning liquid collected in the agitating vessel 2 is drawn out from the fluid outlet 6 of the agitating vessel 2 by the second pump 14, and is returned to the cleaning liquid tank 20 via the circulatory cleaning pipeline 22.

The circulatory cleaning device 80 further comprises a waste fluid tank 25 which receives cleaning waste fluid, and a first directional control valve 23, which switches so that the liquid discharged from the second pump 14 is discharged into the waste fluid tank 25, is provided in the circulatory cleaning pipeline 22.

In one embodiment, a second directional control valve 17 is further provided in the circulatory cleaning pipeline 22. The second directional control valve 17 is capable of switching so that liquid discharged from the second pump 14 is fed to the dispersion apparatus 15. The outlet of the dispersion apparatus 15 is connected to a fluid inlet 5 of the agitating vessel 2 by a pipeline for circulation dispersion 16.

In one embodiment, a third directional control valve 18 is provided in the pipeline for circulation dispersion 16. The third directional control valve 18 is capable of switching so that liquid discharged from the second pump 14 is discharged into a product tank 19. The product tank 19 receives pigment paste which has been subjected to the dispersion process.

There is no particular limitation on the dispersion apparatus 15; and a known pigment dispersion apparatus can be used. In one embodiment, a bead mill is used, as it can produce a high processing flow rate. In another embodiment, as in the example illustrated below, an annular bead mill incorporating a centrifuge which can use small-diameter grinding media is used.

Figure 10:
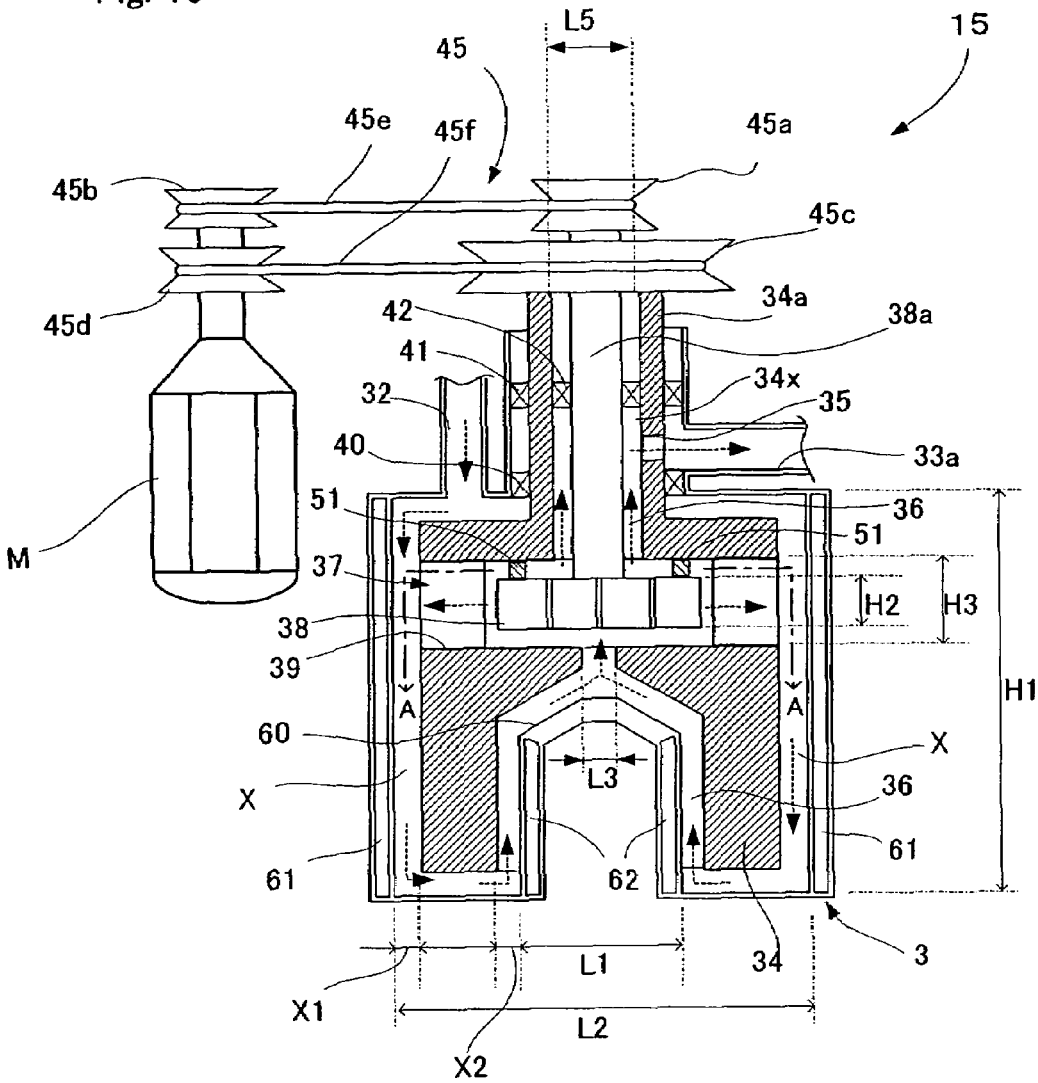
FIG. 10 is a longitudinal sectional view showing a dispersion apparatus incorporated into the system of FIG. 9.

In the dispersion apparatus 15 shown in the cross-sectional view of FIG. 10, a rotor 34 having a cylindrical outer circumferential surface is installed in a vessel 33 in which a inlet 32 is formed. An annular gap X for dispersing pigment is formed between the inner wall of the vessel 33 and the outer wall of the rotor 34.

In one embodiment, the rotational drive shaft 34*a* of the rotor 34 is a hollow shaft, and an outlet opening 35 is formed in said hollow shaft. A passage 36 is formed from a hollow portion 34*x* of the rotational drive shaft 34*a* through the rotor 34, and which opens at the bottom of the rotor 34.

A grinding medium (not shown) is introduced into the vessel 33 in advance. The grain size of the medium can be larger than 3 mm, as of those of the prior art, or can have a very small diameter of 0.05-0.3 mm.

A centrifuge 37 for centrifuging the grinding medium flung through the passage 36 from the pigment paste/pigment paste mixture is disposed inside the rotor 34. In the example illustrated, the centrifuge 37 employs an impeller 38 disposed in the path of the passage 36. To drive out centrifuged grinding medium to the annular gap X, an opening for circulation 39, which communicates the space surrounding the impeller 38 with the annular gap X, is formed in the rotor 34.

The impeller 38 can employ various blades such as flat blades, arrow blades and twisted blades, and has the action of sucking up at the center of the blade and driving out in the circumferential direction, that is, acts as a centrifugal pump. The rotational drive shaft 38*a* of the impeller 38 is inserted into the hollow portion 34*x* of the rotor 34 and protrudes from the rotational drive shaft 34*a* of the rotor 34. It should be noted that 40, 41 and 42 in the Fig. are sealing members.

Figure 11:
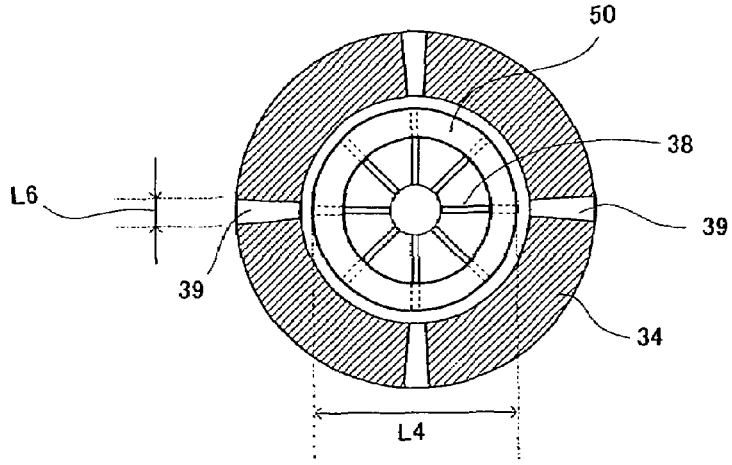
FIG. 11 is a cross-sectional view of FIG. 10 in the plane of A-A.

The impeller 38 comprises, as shown in FIG. 11, an annular plate 50 with an opening through its center from the top face of the impeller 38. In the clearance between this annular plate 50 and the impeller containing space top wall portion of the rotor 34, as shown in FIG. 10, an annular mechanical seal 51 is provided so that the grinding medium is not discharged through said clearance.

Each of the rotational drive shafts 34*a*, 38*a* is connected to a common primary drive M via a transmission mechanism 45 in the example illustrated; however, the primary drives of the rotational drive shafts 34*a*, 38*a* may be connected to different primary drives. In the example shown, the transmission mechanism 45 is a transmission mechanism which is a combination of pulleys 45*a*-45*d*, and pulley belts 45*e*, 45*f* wound around the pulleys 45*a*-45*d*; however, a gear transmission mechanism or like known transmission mechanisms can be employed.

The passage 36 runs from the bottom of the rotor 34 to the center of the impeller 38, i.e., the part which sucks up of the impeller 38. A circulatory channel which runs from the annular gap X to the center of the impeller 38 and reaches the annular gap X again through the outer circumference of the impeller 38 comprises the annular gap X, the passage 36 and the circulating opening 39.

A stator 60 can be fixed at approximately the center of the inner bottom of the vessel 33, with a passage formed by a gap formed between the stator 60 and rotor 34. The stator 60 has a configuration such that a passage is formed at the center of impeller 38 where the suctioning action by rotation is the greatest, whereby the circulation of the grinding medium and pigment paste in the circulatory channel is enhanced. The stator 60 imparts a speed difference due to the gap between the inside of the rotor 34 and the outer wall of the stator 60, and performs dispersion as does as the outer periphery of the rotor 34. The stator 60 in the example illustrated has an upper part formed in a shape of a cylindrical truncated cone, but various other configurations such as a non-truncated cone can be employed.

Jackets 61, 62 are formed in the outer circumferential portion of the vessel 33 and stator 60. A coolant medium is introduced into each of the jackets 61, 62 from a non-illustrated water inlet, and discharged from a non-illustrated water outlet to prevent elevated temperatures inside the vessel 33.

In one embodiment, assuming that the inner diameter of the vessel 33 is 1, the geometric dimensional ratios of the above-mentioned dispersion apparatus 15 are within the following ranges:

The height H1 of the hollow portion inside the vessel 33: 1.0-2.0

The outer diameter L1 of the stator 60: 0.5-0.7

The outer diameter L2 of the rotor 34: 0.95-0.98

The width X1 of the annular gap X: 0.02-0.05

The gap X2 between the rotor 34 and stator 60: 0.02-0.05

The diameter L3 of the portion of the passage 36 which is in communication with the impeller 38: 0.1-0.3

The diameter L4 of the impeller 38: 0.6-0.8

The height H2 of the impeller 38: 0.2-0.3

The inner diameter L5 of the rotational drive shaft 34*a* of the rotor 34: 0.3-0.4

The height H3 of the circulating opening 39: 0.25-0.35

The width L6 of the circulating opening 39: 0.05-0.1

The number of rotation of the impeller 38 may be suitably 1.5-2.0 times that of the rotor 34.

Only one impeller 38 is shown in the aforementioned embodiment, but two or more of the same may be provided, and a static guide blade may be provided as a turbine blade around the impeller 38. In addition, a rotational disk (not shown) may be employed as the centrifuge 37 in place of the impeller 38. When a rotational disk is used, it has less action as a suction pump compared to an impeller, but it is capable of applying centrifugal force to the grinding medium. Moreover, rotary members with various configurations other than a disk shape, such as spheres, elliptical spheres and conical shapes, which can centrifuge a grinding medium by rotation, may be employed.

It should be noted that an impeller can be fixedly or integrally formed in the rotor 34 as a centrifuge to dispense with the rotational drive shaft of the impeller. In this case, the number of rotation (rotation speed) of the impeller becomes equal to that of the rotor. This leads to a reduced centrifugal action, but can reduce the number of parts.

Moreover, the rotor 34 can be provided with a plurality of projections such as pins on its outer circumferential surface to increase its agitating effect.

In addition, the rotational drive shaft 38*a* of the impeller 38 may be extended downward to protrude through the bottom of the vessel 33.

In one embodiment, in a circulation dispersion system having the aforementioned constitution, circulation dispersion is performed by repeating the following cycle: the second directional control valve 17 is switched beforehand so as to feed liquid discharged from the second pump 14 to the side of the dispersion apparatus; pigment paste mixed and agitated by the agitator 1 is drawn out from the agitating vessel 2 through the fluid outlet 6 and fed to the dispersion apparatus 15 by the drive of the second pump 14 via the pipeline for circulation dispersion 16; and the dispersed pigment paste is fed into the agitating vessel 2 from the dispersion apparatus 15 through the fluid inlet 5.

In one embodiment, the amount of pigment paste force-fed to the dispersion apparatus 15 by the second pump 14 is suitably controlled to be within a range that is not too much greater than the centrifugal ability of the impeller 38 constituting the centrifuge.

While being agitated by the rotor 34 along with the grinding medium, the pigment paste pumped to the vessel 33 flows downward through the annular gap X between the inner wall of the vessel 33 and the outer wall of the rotor 34, passes through the gap between the bottom of the rotor 34 and the bottom of the vessel 33, and flows upward through the gap between the inner wall of the rotor 34 and the outer wall of the stator 60. Then, it is suctioned from the center of the rotor 34 into the impeller 38 by the centrifugal pump action of the impeller 38 disposed inside the rotor 34.

The mixture of the pigment paste suctioned into the impeller 38 and the grinding medium is affected by the action of the centrifugal force by rotation of the impeller 38 and the rotor 34 external to it, and thus separates the grinding medium and the pigment paste because of a difference in specific gravity. The grinding medium, with high specific gravity, is discharged to the outer circumference, and returned to the annular gap X between the inner wall of the vessel 33 and the outer wall of the rotor 34 from the openings for circulation 39 formed in the rotor 34. It is then again mixed with the pigment paste, and sent downward through the annular gap X between the inner wall of the vessel 33 and the outer wall of the rotor 34.

As already mentioned, circulation of the grinding medium, which moves to the passage 36 running from the annular gap X into the rotor, due to the flow the pigment paste and returns through the circulating opening 39 by the impeller 38, is repeated. During this time, agglomerates (secondary particles) of the pigment contained in pigment paste are dispersed into primary particles by the strong shearing action caused by collisions with the grinding medium in the annular gap X between the inner wall of the vessel 33 and the outer wall of the rotor 34.

The grinding medium separated from the pigment paste by the impeller 38 flows upward through the gap between the hollow portion 34*x* of the rotational drive shaft 34*a* of the rotor 34 and the rotational drive shaft 38*a* of the impeller 38, runs through the outlet opening 35 formed in the rotational drive shaft 34*a* of the rotor 34, and are discharged from an outlet 33*a*. Discharged pigment paste is returned to the agitating vessel 2 via the pipeline for circulation dispersion 16. Circulation dispersion is performed by this repeated circulation.

After circulation dispersion is thus completed, the pigment paste is discharged to a product tank 19 via a third directional control valve 18. The pigment paste remaining in the agitating vessel 2 and dispersion apparatus 15 is then removed by cleaning.

Specifically, after the pigment paste is discharged to the product tank 19, the first pump 24 is driven to provide a cleaning liquid from the cleaning liquid tank 20 to the agitating vessel 2. At this time, the cleaning liquid is sprayed at high pressure like a shower from the cleaning nozzle 21 so that initial cleaning is performed.

When a certain amount of the cleaning liquid is collected in the agitating vessel 2, the first pump 24 is stopped and the second pump 14 is driven to perform circulation cleaning of the circulation dispersion system by circulating a cleaning liquid through the agitating vessel 2, dispersion apparatus 15, and pipeline for circulation dispersion 16. At this time, the cleaning liquid is collected in the agitating vessel 2, the flat paddle blade 4 constituting the agitating blade is backwards and forwards rotated, whereby the flat paddle blade 4 and the inner wall of the agitating vessel 2 can be cleaned. While the cleaning liquid is circulating through the circulation dispersion system, the dispersion apparatus is also driven so that the dispersion apparatus can also be cleaned efficiently.

When the cleaning liquid is contaminated to a certain degree by circulation cleaning and the cleaning liquid loses the desired cleanability, the cleaning liquid is discharged to the waste fluid tank 25 by switching the second directional control valve 17 and first directional control valve 23, and fresh cleaning liquid is poured into the cleaning liquid tank 20. This allows circulation cleaning once more of the aforementioned circulation dispersion system.

After the circulation dispersion system cleaning is finished, the second directional control valve 17 is switched so that discharge from the second pump 14 is sent to the cleaning liquid tank 20. Circulation cleaning of the circulation cleaning system is performed by circulating cleaning liquid through the circulation cleaning system comprising the agitating vessel 2, circulatory cleaning pipeline 22, and cleaning liquid tank 20. It should be noted that in this case also, the cleaning liquid can be replaced with fresh cleaning liquid prior to the circulation cleaning of the circulation cleaning system. After the circulation cleaning system is cleaned, the first directional control valve 23 is switched so that the cleaning waste fluid is discharged to the waste fluid tank 25.

In the aforementioned description, the circulation cleaning system is subjected to circulation cleaning after the circulation dispersion system is subjected to circulation cleaning; however, the circulation cleaning system may be cleaned first.

The above-mentioned circulation cleaning steps can be automatically performed by sequence control. More specifically, by using electromagnetic valves for the first to third directional control valves 23, 17, 18, opening and closing the first to third directional control valve 34, 17, 18 and driving and stopping of the first pump 24 and second pump 14 may be controlled by a controller according to a predetermined sequence program so that the aforementioned cleaning steps are performed automatically.

This control may be such that the surface of the liquid in the cleaning liquid tank 20 and/or agitating vessel 2 is detected by a liquid surface sensor (not shown), the detection signal is integrated into the control system, and the cleaning liquid is circulated through the circulation cleaning line, while driving and stopping of the first pump 24 and second pump 14 are controlled. In one embodiment, circulation of the cleaning liquid need not necessarily be continuous but may be intermittent.

In one embodiment, the pigment paste to be processed has a viscosity in the range of from 0.01 Pa·sec to 100 Pa·sec, especially from 0.1 Pa·sec to 10 Pa·sec, and has a TI value ranging of 1-10, especially ranging 1-5. Said TI value is an abbreviation of thixotropic index, and is a value obtained by converting the numerical values determined (temperature: 20° C., number of rotations of rotor: 6 and 60 rpm) by the rotation viscosity method described in JIS K5101-6-2 to a mPa·s basis and calculating the apparent viscosity in mPa·s at 6 rpm divided by the apparent viscosity mPa·s at 60 rpm.

Moreover, when the viscosity of the pigment paste is high and the TI value is high, the adhesive power of the pigment paste is high. Therefore, the inner wall face of the agitating vessel 2, the surface of the agitating blade 8, and the inner surfaces of the pipes are desirably smoothened by mirror finishing, Teflon® coating, glass lining or like treatment.

In an agitator having the constitution of the aforementioned first embodiment, pigment pastes with high TI values and pigment pastes of high viscosity and the like can be cooled by a flat paddle blade having a large heat transfer area and a high contact frequency with a fluid even in cases when a sufficiently high rate of heat transfer (cooling rate) can not be achieved by a coolant jacket only, thus improving the cooling efficiency. Hence, pigment paste can be mixed in a shorter period than the residence time of in the agitating vessel 2. Accordingly, when the agitator of the aforementioned first embodiment is employed in the aforementioned circulation dispersion system, dispersibility can be improved.

Figure 7:
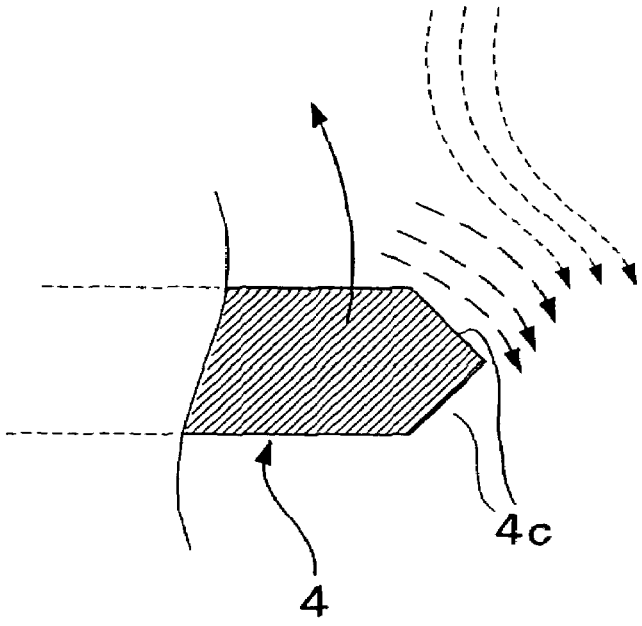
FIG. 7 is an illustrative drawing showing the action of a component the agitator of FIG. 1, a flat paddle blade.
Figure 8:
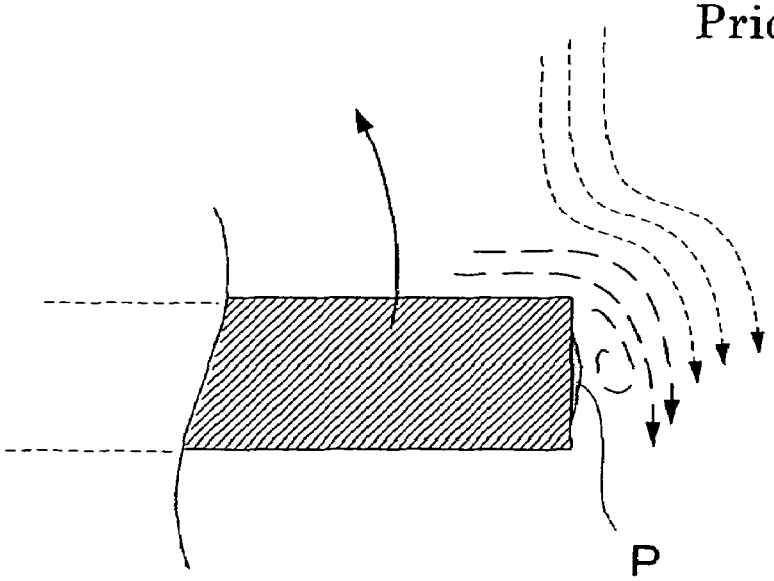
Fig. 8 Prior Art
FIG. 8 is a horizontal sectional view showing how a prior art flat paddle blade is used.

Moreover, as shown in the aforementioned second embodiment, if the peripheral edge of the flat paddle blade 4 is tapered by the two inclined surfaces 4*c*, 4*c*, as shown in the cross-sectional view of FIG. 7 along with the flow (broken line arrows) of the cleaning liquid, when the flat paddle blade 4 rotates backwards and forwards (in FIG. 7, shown in only one direction), the pigment paste deposited on each inclined surface can be pushed by the flow of the cleaning liquid and removed efficiently.

In one embodiment, from such an efficiency perspective, when the outermost periphery of the flat paddle blade 4 is configured to have a V-shaped peripheral configuration formed by the two inclined surfaces 4*c*, 4*c*, each of the inclined surfaces 4*c* is formed so that the internal angle $\theta_1$ (refer to FIG. 4) between itself and the flat surface (front or rear) of the flat paddle blade 4 is in the range of from 100°-140°. If this angle of inclination $\theta_1$ is less than 100°, the pigment paste is likely to deposit on the flat surface. If the angle of inclination $\theta_1$ is greater than 140°, the strength of the flat paddle blade 4 is lowered, and when subjected to fluorine resin coating or glass lining, the lining is likely to come off because of contraction stress.

Moreover, since the agitating vessel 2 has a bottom configuration of a truncated cone tapering downwards as already stated, this forms a laminar flow along the inclined surface of the bottom when a cleaning liquid is circulated through the dispersion line. As a result, pigment paste deposited on the bottom of the agitating vessel 2 can be efficiently removed.

In one embodiment, from such an efficiency perspective, the bottom conical surface of the agitating vessel 2 has such an inclination that the angle $\theta_2$ (refer to FIG. 1) between itself and the horizontal plane is 5°-30°. If the angle of inclination $\theta_2$ is less than 5°, pigment paste is likely to pool around the joint of the body and the bottom of the tank, hindering the flow of pigment paste to the fluid outlet 6 during circulation cleaning. If the angle of inclination $\theta_2$ is greater than 30°, the pigment paste is likely to short-path.

The invention claimed is:

1. An agitator comprising:

an agitating vessel comprising a fluid inlet in an upper part thereof, a fluid outlet at the bottom and having a cylindrical peripheral configuration;

a rotating shaft extending vertically inside the agitating vessel; and a flat paddle blade mounted on said rotating shaft, the flat paddle blade having a bottom flat paddle blade portion which extends outwards from the bottom of the rotating shaft and a oblong upper flat paddle blade portion extending upward from an upper part of each side end of the bottom flat paddle blade portion, wherein the bottom flat paddle blade portion has a planar outer surface over substantial the width of the bottom flat paddle blade portion; and wherein the dimensional ratio (b/a) of the blade diameter (b) of the bottom flat paddle blade portion to the inner diameter (a) of the agitating vessel is from 0.6 to 0.9, the dimensional ratio (d/c) of the height (d) of the upper flat paddle blade portion to the height (c) of the bottom flat paddle blade portion is from 1 to 4, and the shaft and blade are embedded with a passage to pass a coolant medium inside the rotating shaft and the flat paddle blade, wherein the passage comprises a coolant path and has a substantially fixed width for the entire length of the passage within the blade, and wherein the coolant path is located in the blade.

2. An agitator according to claim 1, wherein a coolant jacket is further provided around the agitating vessel.

3. An agitator according to claim 1, wherein the outermost periphery of the flat paddle blade is tapered by two inclined surfaces, and wherein a tip tapered by the inclined surfaces is formed as a sharp point or in a rounded U-shaped cross-sectional configuration.

4. An agitator according to claim 3, wherein the outermost periphery of the flat paddle blade has a V-shaped peripheral configuration due to the two inclined surface, and each of said inclined surfaces is formed so that the internal angle ($\theta_1$) between a flat surface of the flat paddle blade and the inclined surface is in the range of from 100° to 140°.

5. An agitator according to claim 4, wherein the bottom configuration of the agitating vessel is the shape of a cone or truncated cone tapering downwards, and the bottom configuration of the bottom flat paddle blade portion is formed parallel to the bottom of the agitating vessel.

6. An agitator according to claim 5, wherein the bottom conical surface of the agitating vessel is inclined so that the angle ($\theta_2$) of the inclined surface is 5°-30° from the horizontal.

7. An agitator according to claim 1, wherein the dimensional ratio (e/b) of the width (e) of the upper flat paddle blade portion to the blade diameter (b) of the bottom flat paddle blade portion is 0.05-0.2.

8. An agitator comprising:

an agitating vessel comprising a fluid inlet in an upper part thereof, a fluid outlet at the bottom and having a cylindrical peripheral configuration;

a rotating shaft extending vertically inside the agitating vessel; and a flat paddle blade mounted on said rotating shaft, the flat paddle blade having a bottom flat paddle blade portion which extends outwards from the bottom of the rotating shaft and a oblong upper flat paddle blade portion extending upward from an upper part of each side end of the bottom flat paddle blade portion, wherein the bottom flat paddle blade portion has a planar outer surface over substantial the width of the bottom flat paddle blade portion, wherein the shaft and blade are embedded with a passage to pass a coolant medium inside the rotating shaft and the flat paddle blade, wherein the blade comprises a coolant path for receiving an incoming coolant and discharging an outgoing coolant, and wherein the coolant path is bent a plurality of times inside the blade.

9. An agitator according to claim 1, wherein the coolant path is throughout the blade.

* * * * *

UNITED STATES PATENT AND TRADEMARK OFFICE

CERTIFICATE OF CORRECTION

PATENT NO. : 7,540,651 B2
APPLICATION NO. : 11/092294
DATED : June 2, 2009
INVENTOR(S) : Matsumoto et al.

It is certified that error appears in the above-identified patent and that said Letters Patent is hereby corrected as shown below:

On the Title Page, Item (73) Assignee:, Change "Hogyo-ken (JP)," to --Amagasaki-shi (JP)--.

At Column 8, line 62, Change "15;" to --15,--.

Signed and Sealed this

Sixteenth Day of November, 2010

David J. Kappos

David J. Kappos
*Director of the United States Patent and Trademark Office*